United States Patent [19]

Hueschen

[11] Patent Number: 4,783,198

[45] Date of Patent: Nov. 8, 1988

[54] COAL WATER SLURRY COMPOSITIONS BASED ON LOW RANK CARBONACEOUS SOLIDS

[75] Inventor: Gordon W. Hueschen, Warren, N.J.

[73] Assignee: AB Carbogel, Helsingborg, Sweden

[21] Appl. No.: 119,581

[22] Filed: Nov. 12, 1987

Related U.S. Application Data

[63] Continuation of Ser. No. 796,959, Nov. 12, 1985, abandoned.

[51] Int. Cl.[4] ..... C10L 1/32

[52] U.S. Cl. ..... 44/51; 252/351; 44/62; 44/77

[58] Field of Search ..... 44/51, 62, 77; 252/351

[56] References Cited

U.S. PATENT DOCUMENTS

| | | | |
|---|---|---|---|
| 4,441,889 | 4/1984 | Mark | 44/51 |
| 4,468,232 | 8/1984 | Funk | 44/51 |
| 4,583,990 | 4/1986 | McGarry | 44/51 |

FOREIGN PATENT DOCUMENTS

| | | | |
|---|---|---|---|
| 1188595 | 11/1985 | Canada | 44/51 |
| 2141135 | 12/1984 | United Kingdom | 44/51 |

*Primary Examiner*—William R. Dixon, Jr.
*Assistant Examiner*—Margaret B. Medley

[57] ABSTRACT

The invention relates to a coal water slurry composition based on low rank carbonaceous solid, characterized in that it contains a minor portion of high rank carbonaceous solid, the high rank carbonaceous solid being milled to a finer average size than the lower rank carbonaceous solid.

9 Claims, No Drawings

COAL WATER SLURRY COMPOSITIONS BASED ON LOW RANK CARBONACEOUS SOLIDS

This is a continuation of application Ser. No. 796,959, filed Nov. 12, 1985, now abandoned.

BACKGROUND OF THE INVENTION

1. Field of Invention

Coal water slurry composition based on low rank carbonaceous solids.

2. Prior Art

The basic coal water mixture fuel technology has emerged as one potential answer to uncertain fuel oil supply to the electricity generating industry during the past two decades. As is evident from numerous patents in the field, coal water mixture technology provides methods to manufacture fuels based on finely pulverized coal and water and wherein different chemicals are used to enhance both the solids concentration of the fuels and the pumpability and combustibility of such slurry fuels.

Although it may well be said that coal water mixture fuels have proven technically and economically useful alternatives to fuel oil, it is equally true that considerable improvement over the present state of the art is required to fully utilize the potential benefits of the coal water fuel concept.

For example, U.S. Pat. No. 4,282,006 discloses a combination of particles of a claimed unique particle size distribution with dispersing chemicals and water to form particularly advantageous slurry fuels, and U.S. Pat. No. 4,358,293, discloses the use of nonionic surface active materials incorporating a hydrophobic portion and a hydrophilic portion comprising at least 100 repeating ethylene oxide units to form slurries of coal in water. In particular, the patent discloses a method of cleaning the finely divided coal which includes a pretreatment of the coal particles with various chemicals and oils to render their surfaces oleophilic and hydrophobic. Thus, cleaned coal is slurried with water and nonionic surfactants to yield directly burnable fuels. The fuels may also contain various salts and polymeric stabilizers which serve to keep the particles of pretreated coal in suspension.

U.S. Pat. No. 4,470,828 discloses compositions of coal water slurry fuels which have enhanced stability and pumpability. Combinations of certain chemicals are responsible for producing these advantageous effects. Thus, the patent teaches the use of particular anionic surface active agents in combination with either polyether polyols or esterified such compounds, or phosphated, sulphated or carboxylated such compounds.

Such teachings show that functioning slurries of fine coal in water can be made by paying attention to particle size distribution, coal surface conditioning and selection of dispersing chemicals. One patent, U.S. Pat. No. 4,501,205, even teaches the blending of different coals into the slurry. The patent teaches (col. 7, lines 17–25) the use of at least one coarse carbonaceous fraction, such as anthracite or low volatile bituminous coal and at least one fine carbonaceous fraction such as lignite, to make up the slurry solids. In other words, the patent teaches the use of at least two types of coal to make up the solids of the slurry whereby the fine fraction is a lower rank coal and the coarser fraction is a higher rank coal.

A particular weakness of present day coal-water mixture fuel technology appears to be a greatly increased need and decreasing efficiency of dispersing chemicals with decreasing rank of the coal involved. This predicament is doubly unfortunate because the mining cost of lower rank coals, i.e., coals with relatively high oxygen content, is normally significantly lower than that of high rank coals, i.e., coals with relatively low oxygen content. Slurry fuels based on lower rank coals could potentially offer very significant economic benefits as replacement fuels for increasingly scarce fuel oil produced from finite supplies. Lower rank coals as slurry fuel feedstock further offer the distinct environmental advantage of containing very low sulfur concentrations; in fact, lower than the high rank coals which are presently used as suitable coal-water mixture fuel feedstock.

Recent publications, such as "Effects of coal type, surfactant, and coal cleaning on the rheological properties of coal water mixtures" (Kaji et al., 5th International Symposium on Coal Slurry Combustion and Technology, U.S. DOE, Tampa, Fla., Apr. 25–27, 1983) clearly show that coals with higher oxygen contents, commonly exceeding some 6 to 8 weight precent in the ultimate analysis (ASTM procedure D3176-74 (1979), dry and mineral matter free basis) require high levels of addition of surface active dispersing agents before they flow, even at very low solids concentrations. In fact, using nonionic surface active dispersing agents in accordance with U.S. Pat. No. 4,358,293, or anionic dispersing agents as taught in e.g., U.S. Pat. No. 4,504,277, it has been found that lower rank coals, i.e., coals with more than 6–8% oxygen (ASTM D3176-74, dmmf) frequently require high amounts of dispersing agent. Such high addition levels bring the cost of manufacturing the slurry fuels to a level where the commercial feasibility suffers.

PRESENT INVENTION

It has now been surprisingly found that a coal-water slurry can be prepared from coal of lower rank, in which both solids concentration and chemical additions are in a much more favorable range than hitherto reported for slurries containing substantial amounts of lower rank coals. According to the invention this is achieved by using coal which consists of a major portion of lower rank coal and a minor portion of higher rank coal, the higher rank coal portion having a smaller average particle size than the lower rank coal portion.

The external surface area of the finer fraction is at least about forty percent (40%) of the total slurry solid external surface area, the lower rank coal preferably has an oxygen content at least two (2) percentage units greater than the higher rank coal, the lower rank coal preferably has an oxygen content above six percent (6%), and the higher rank coal preferably has an oxygen content which is less than six percent (6%).

Surface active dispersing chemicals which are employed in such slurries are less critical, but it has been found that surface active chemicals comprising hydrophobic and hydrophilic portions and at least 40 repeating ethylene oxide units are especially suitable, either alone or in combinations with other surface active agents. Such agents have been found to be very efficient flow enhancing agents for a broad range of coal types and are disclosed in U.S. Pat. No. 4,549,881 and U.S. application Ser. No. 492,196, filed May 6, 1983 and issued as U.S. Pat. No. 4,565,549 on Jan. 21, 1986, and in corresponding published Swedish Patent Application No. 8202879-6 (open to public inspection Nov. 7, 1983) and in corresponding printed PCT Publication No. WO83/04044, Published Nov. 24, 1983, hereby incorporated by reference. Other suitable dispersing agents are the same in combination with various ionic dispersing chemicals well known in the art through, e.g., U.S. Pat. Nos. 4,504,277, 4,470,828 and 4,282,006.

Contrary to the teachings of U.S. Pat. No. 4,501,205, however, the finer fraction of the combined solids in the slurry fuel composition must be of higher rank than the coarser fraction, and thus contain less oxygen than the coal of the coarser fraction. The finer fraction may be made up of a relatively high rank coal or any other hydrophobic carbonaceous solid such as, e.g., petroleum coke or solid asphaltenes. It has further been found that the improvement is particularly significant if the surface area of the finer, more hydrophobic and less oxygen containing portions of the solids constitutes more than half of the total surface area of the solids in the slurry fuel composition, whilst contituting less than half of the weight of slurry solids.

The particular advantages realized by practicing this invention lie in that slurry fuels which are pumpable and directly burnable can be manufactured at significantly higher coal loadings than when using the lower rank coal alone and that slurry fuels can be manufactured using lower amounts of dispersing agents than when using the lower rank coal alone. Thus, less costly coals can be used to make the fuels, less chemicals can be used to make them, and the combustion efficiency will be significantly improved owing to a lower moisture content. As is apparent from the examples which follow, the slurry fuels prepared in accordance with the invention yield results similar to those obtained when using the minority constituent of the slurry fuel alone to make up a slurry. It should be noted that the same advantageous effects will be realized if one chooses to use groups of coals or carbonaceous solids rather than singular coals or carbonaceous solids to make up the two fractions of slurry fuel solids, as long as the minority solid fuel on the average has a lower oxygen content and displays a higher degree of hydrophobicity than the majority fraction of the slurry fuel solids. The most significant improvement is realized when the surface area of the solids making up the more hydrophobic portion of the slurry fuel solids is greater than half the total surface area of the slurry fuel solids. Preferably the higher rank coak has at least twice as great and preferably more than three times as great an external surface area as the lower rank coal employed. It is important to note that the surface area referred to is the external surface area, i.e., not including pore surface area.

Such surface area can be determined, e.g., by means of particle size distribution measurement using Coulter Counter, Microtrac, or Malvern instruments, from which measurement an equivalent spherical surface area can be calculated. The method is not precise in that it assumes spherical particle shapes from a measurement of particle volume, but it yields an accuracy which is quite sufficient to practice the invention, as long as the external surface areas of both groups of slurry fuel solids are measured using the same techniques.

The oxygen content of the coal or other carbonaceous solids used in practising the invention is measured according to the standard ASTM method for determining the oxygen content of coals in the ultimate analysis, dry and mineral matter free basis (ASTM D3716-74). As is apparent from the examples below, coals or other carbonaceous solids with oxygen contents of up to 8 percent by weight, preferably up to about 6 percent by weight, can advantageously be used as the minority weight fraction of coal in the slurry fuel, whereas coals containing more than 6 percent, preferably more than about 8 percent, oxygen are suitable as the majority fraction. Examples of the former group of solid fuels are anthracite, low volatile bituminous coal, and petroleum coke whereas lignities, sub-bituminous coals, and lower rank (i.e., high rolatile) bituminous coals are suitable starting materials within the latter group.

DETAILED DESCRIPTION OF THE INVENTION

The following examples are given by way of illustration only and are not to be construed as limiting.

EXAMPLES 1-7

Two coals were selected. A high rank bituminous coal with an oxygen content of 5.1% (ASTM D3176-74 ultimate analysis, dmmf) from Tennessee Consolidated Coal Company was milled to a fine powder with 96% by weight of the particles being of a diameter smaller than 16 microns. This coal fraction is referred to as coal "A-1" hereunder. Another fraction was prepared wherein the coarsest particles were of a diameter of about 44 μm. This fraction is referred to as coal "A-2" hereunder. As a higher oxygen containing coal, a sub-bituminous coal from Hokkaido, Japan, was chosen. The coal is named Taiheiyo coal and contains 13% oxygen (ASTM D3176-74 ultimate analysis, dmmf). It was milled to a fineness whereby 99 percent of the particles by weight had a diameter smaller than 210 microns. This fraction is referred to as coal "B" hereunder.

REFERENCE EXAMPLES

Tailheiyo coal milled to a top particle size of 210 microns and a total particle external surface area of 34 $m^2$ per 100 grams of coal could be slurried only at a solids concentration of no more than about 66% by weight of coal with sufficient pumpability of the slurry. The dispersing agent used was nonionic ethoxylated dinonylphenol with about 70 repeating units of ethylene oxide. For purposes of direct comparison, the same type of dispersing agent was used in examples 1 through 11. It should be noted that, in dealing with mixtures of coals in slurries, it has been found that particular blends of ionic and essentially nonionic dispersing agents in many cases are very efficient. It is preferred that the nonionic or essentially nonionic species comprise more than about 40 repeating ethylene oxide units.

The slurry based on Taiheiyo coal had a viscosity of 840 cps at 100 reciprocal seconds shear rate at 65.8% coal loading and required 15.2 grams of dispersing agent per kilogram of coal.

The bituminous coal from Tennessee Consolidated was milled to a similar fineness and size distribution as the Taiheiyo coal. Slurries with well over 70 weight percent coal could be made with this coal. At 70 percent coal, the slurry had a viscosity of 200 cps at 100 reciprocal seconds shear rate and required 7.8 grams of the dispersing agent per kilogram coal. At 68% coal loading, the corresponding viscosity was about 100 cps and the dispersant requirement was 7.3 grams per kilomgram of coal.

EXAMPLE 1

Twenty-five weight percent of coal "A-2" and 75 weight percent of coal "B" were combined to yield an aqueous slurry at 65% solids loading. When combined in this ratio, coal "A-2" provided about 60% of the total coal particle surface area, since the surface area of "A-2" was 89.5 $m^2$ per 100 grams of coal and that of coal "B" was 20.2 $m^2$ per 100 grams of coal.

A linear prediction based on the slurrying results using the coals separately would lead to an expected viscosity of the slurry of 655 cps at a dispersant requirement of 13.3 grams per kilogram of coal.

The actual results were 410 cps viscosity at a dispersant level of 9.6 grams per kilogram of coal. Thus, by combining a low and a high oxygen containing coal in a slurry, with the lower oxygen coal being a minority weight constituent, yet providing a substantial amount of the total external coal surface area, unexpected reductions of both viscosity and dispersant requirement were achieved.

EXAMPLES 2–7

(EXAMPLE 6 is COMPARATIVE).

Table 1 below shows results of a series of 6 further tests carried out with the prepared coal fractions.

TABLE 1

| Coal Fraction | | | Solids | % Surface Area | Dispersant | Expected | Viscosity @ | Expected | |
|---|---|---|---|---|---|---|---|---|---|
| A-1 | A-2 | B | Concentration | Coal A | Requirement[1] | Requirement[1] | 100 $s^{-1}$ (CPS) | Viscosity (CPS) | Example |
| — | 25% | 75% | 65.8% | 60% | 9.6 | 13.3 | 410 | 655 | 1 |
| 25% | — | 75% | 65.6% | 68% | 8.7 | 13.3 | 320 | 655 | 2 |
| — | 20% | 80% | 65.6% | 51% | 9.9 | 13.7 | 380 | 690 | 3 |
| 20% | — | 80% | 65.4% | 61% | 9.3 | 13.7 | 350 | 690 | 4 |
| 10% | — | 90% | 65.5% | 41% | 10.5 | 14.5 | 505 | 765 | 5 |
| — | 10% | 90% | 65.3% | 32% | 12.2 | 14.5 | 620 | 765 | 6 |
| 20% | — | 80% | 68.2% | 61% | 12.6 | n.a.[2] | 560 | n.a.[2] | 7 |

[1]grams/kg of coal

[2]Since coal B, Taiheiyo cannot be slurried at a solids concentration over 66%, no reasonable expected value can be calculated.

As is shown by the examples, the best results are achieved when the surface area provided by the lower oxygen coal is as great as possible at any given minority weight fraction of such coal. The best results are obtained when the surface area of the minority weight constituent is more than about 50% of the total surface area, although improvements are seen in the lower range. These latter improvements are significant when using relatively small amounts of the lower oxygen coals. Example 7 shows an interesting results in that a Taiheiyo coal containing slurry can be produced at 68.2% solids concentration at a lower viscosity and lower dispersing agent concentration than pure Taiheiyo coal slurries demand at the maximum attainable concentration of 66% coal. In other experiments it has been shown that, in order to obtain any slurry improvements when high and lower oxygen containing coals are used, when the particle sizes of the different fractions are about equal, only marginal improvements, if any, are recorded unless than lower oxygen containing coal is used as a majority weight component. At this point, however, the results do not deviate from the expected when performing a linear interpolation of results obtained from slurries made of the two components separately. In yet other experiments where the higher oxygen containing coals are used as the finer minority fraction of the combined slurry, no advantageous results are found.

EXAMPLES 8 AND 9

(EXAMPLE 8 IS COMPARATIVE)

Two different coals were selected; one which could easily be slurried with solids concentrations exceeding 70% by weight and one that only with difficulty could be slurried at 67% solids concentration. The former coal was supplied by Cape Breton Development Corporation, Nova Scotia, Canada, from the Harbour Seam Lingan Mine. This coal had an oxygen content of 4.3% (ASTM D3176-79, ultimate analysis, dmmf) and required about 5.5 grams of dispersing agent per kilogram of coal to yield a 67% solids concentration slurry wherein the particle top size was about 210 microns and the external surface area of the particles was about 36 $m^2$ per 100 grams of coal. At 70% solids concentration, the coal was slurried at a dispersing agent requirement of 7.1 grams per kilogram of coal. The latter coal was a sub-bituminous coal from the Kayenta Mine, Ariz., containing 13.9% oxygen (ASTM D3176-74, ultimate analysis, dmmf). This coal could not be slurried at solids concentrations above 67%, the top size of the particles being 210 microns and the total external surface area being about 36 $m^3$/100 grams, and even at this concentration the dispersing agent requirement was 29.2 grams per kilogram coal.

TABLE 2

| Slurry Properties: Lingan and Kayenta Coal | | | |
|---|---|---|---|
| Coal | Solids Concentration | Dispersant Requirement | Viscosity (CPS) at 100 $s^{-1}$ Shear Rate |
| Kayenta Mine | 67% | 29.2 g/Kg | 1400 |
| Lingan Mine | 67% | 5.5 g/Kg | 60 |
| Lingan Mine | 70% | 7.1 g/Kg | 200 |

To carry out Examples 8 and 9, Kayenta coal was milled to a particle top size of 210 microns and an external particle surface area of 25.2 $m^2$ per 100 grams of coal, and the Lingan coal was milled to a particle top size of 27 microns and an external particle surface area of 137 $m^2$ per 100 grams. The slurry results are shown in Table 3.

TABLE 3

| EXAMPLE | COAL LINGAN | COAL KAYENTA | SOLIDS CONCENTRATION | FRACTION SURFACE AREA LINGAN | DISPERSANT REQUIREMENT | EXPECTED | VISCOSITY @ 100 $s^{-1}$ (CPS) | EXPECTED (CPS) |
|---|---|---|---|---|---|---|---|---|
| | | | | Examples 8 and 9 | | | | |
| 8 | 10% | 90% | 67% | 38% | 21.8 g/Kg | 26.8 g/Kg | 970 | 1270 |
| 9 | 25% | 75% | 67% | 59% | 15.1 g/Kg | 23.3 g/Kg | 660 | 1065 |

The table shows the improvements in dispersant requirement as well as slurry viscosity obtained when combining the coal fractions in accordance with the invention. Significantly between results are obtained than those predicted by linear interpolation.

EXAMPLES 10 AND 11

A lignite coal, Semirara coal from the Philippines with 19% oxygen (ASTM D3176-74, ultimate analysis, dmmf), was used as the coarse fraction in slurries wherein this coal was combined with varying amounts of fraction "A-1" from Examples 1 through 7. The Semirara lignite yielded slurries at a maximum solids concentration of 55% at a dispersant requirement of about 69 grams per kilogram of coal when the slurry solids had a top size of about 210 microns and an external surface area of about 35$m^2$ per 100 grams of coal. The viscosity of the slurry was about 1830 cps at 100 $s^{-1}$ shear rate. Table 4 shows the results of Examples 10 and 11. The Semirara coal was milled to a top size of 210 microns and an external surface area of 25.2 $m^2$ per 100 grams of coal for the tests.

TABLE 4

| COAL Semirara | COAL A-1 | DISPERSANT REQUIREMENT | SOLIDS CONCENTRATION | VISCOSITY 100 $s^{-1}$ (CPS) | SURFACE AREA A-1 | EXAMPLE |
|---|---|---|---|---|---|---|
| 80% | 20% | 56 g/Kg | 58.2% | 1790 | 56% | 10 |
| 75% | 25% | 42 g/Kg | 61.0% | 1810 | 63% | 11 |

The examples illustrate how a coal combination in accordance with the invention can yield slurries largely based on a lignitic coal with solids concentrations higher than possible with only the lignite and yet at dispersant concentrations and viscosities lower than those attainable with only lignite as feedstock at the maximum solids concentrations for lignite slurries. These advantages are even greater when the lignite has a larger particle size than in the above examples.

All the foregoing examples illustrate the invention. By providing at least two solid carbonaceous materials to a slurry composition whereby a minority fraction, by weight, comprises material with an oxygen content of less than about 8 percent by weight (ASTM D3176-74 dmmf), preferably less than about 6 percent, and is milled to a finer average particle size than the majority fraction of carbonaceous particles, by weight, which are produced from a carbonaceous solid material containing more than 6 percent by weight of oxygen (ASTM D5176-74, ultimate analysis, dmmf), preferably more than about 8 percent oxygen, considerable advantages are gained. Slurries can be made using less surface active flow enhancing chemicals than would be required when using only the carbonaceous substrates which make up the coarser component of the novel compositions. Attainable solids loadings are higher and viscosities are lower.

Although advantages are present already in slurry compositions containing no flow enhancing chemicals, the best results are achieved when the carbonaceous solids are dispersed with surface active materials or other flow enhancing and stability inducing chemical additives. Particularly good results are obtained when the compositions include surface active dispersing agents comprising at least 40 repeating ethylene oxide units, either alone or in combination with ionic dispersing agents of a cationic, nonionic, or amphoteric nature. Such combinations have been taught by, e.g., Yamamura in U.S. Pat. No. 4,470,828.

In selecting suitable substrates for the two different particle fractions comprising the slurry solids, the finer particles may contain, on the average, up to 8 weight percent oxygen (ASTM D3176-74 ultimate analysis, dmmf) and preferably up to 6 weight percent oxygen. At all times, the coarser particles must contain, on the average, more oxygen than the finer minority fraction in order to obtain the advantageous of the invention.

The typical moisture contents of the slurries according to the invention may range from about 50 percent by weight, preferably 45 percent, to about 20 percent, preferably about 25 percent. The particle sizes will range from nominal largest size higher oxygen containing particles to the finest sizes normally generated when milling each type of selected carbonaceous feedstock. Said largest particle may be of a diameter of some 50 to 300 microns if the slurry fuel is designed to be directly fired, up to about 1500 microns if the slurry is intended for, e.g., gasification feedstock, or it may be up to several inches in diameter if the slurry composition is intended for, e.g., pipeline conveyance or transportation in concentrated bulk form. For slurries according to the invention, it is preferred that the particle top size of the minority solids fraction be at least about 10 microns if the largest particle size of the composition is up to about 250 microns. For slurry particle top sizes of up to about 2 millimeters, the diameter of the largest particle of the minority solids fraction can suitably be at least about 5% of the diameter of the largest particles in the combination slurry.

Suitable methods of producing slurries or slurry fuels according to the invention can be employed in a variety of ways. In one preferred process, the coarse particles of carbonaceous material are produced separately in one size reduction process specifically selected to produce minimum amounts of very fine material. Examples of suitable unit processes are closed or open circuit operated wet rod mills. The fine particles are preferably generated in wet milling operations specifically designed to produce very small particles such as wet ball mills, attrition mills, stirred ball mills, or the like. The milling of the finer particles can advantageously be carried out in the presence of suitable flow enhancing chemicals, such as surface active dispersing agents comprising at least 40 ethylene oxide units either alone or in combination with ionic dispersants suitable for dispersion of carbonaceous particles in water. The product streams from the separate size reduction process steps are later combined to yield the product slurry or slurry fuel. Suitable processes may include other steps such as deashing of either or both of the milled products, various dewatering stpes, and other well known operations as determined to be advantageously employed by one skilled in the art.

Various modifications and equivalents will be apparent to one skilled in the art and may be made in the compounds, compositions, methods, and procedures of the present invention without departing from the spirit or scope thereof, and it is therefore to be understood that the invention is to be limited only by the full scope which can be legally attributed to the appended claims.

I claim:

1. Coal water slurry composition based on low rank carbonaceous solid, which has a greater oxygen content than high rank carbonaceous solid, wherein the slurry, in addition to the water consists essentially of (I) said low rank carbonaceous solid (II) a minor portion of high rank carbonaceous solid, the high rank carbonaceous solid being milled to a finer average size than the lower rank carbonaceous solid, wherein the external surface area of the finer fraction is at least about 40% of the total slurry solid external surface area; and (III) an effective amount of a flow enhancing-chemical comprising a nonionic dispersant.

2. Composition of claim 1, including a flow enhancing chemical comprising a nonionic dispersing agent having more than about forty repeating ethylene oxide units.

3. Composition of claim 1, wherein carbonaceous solid comprises coal wherein lower rank coal has an oxygen content at least two percentage units greater than the higher rank coal.

4. Composition of claim 1, wherein the carbonaceous solid comprises coal wherein lower rank coal has an oxygen content above 6%.

5. Composition of claim 1, wherein the carbonaceous solid comprises coal wherein higher rank coal has an oxygen content which is less than 6%.

6. Composition of claim 1, wherein the carbonaceous solid comprises coal wherein higher rank coal has a surface area greater than one half of the surface area of the total solids in the composition.

7. Composition of claim 1, wherein the carbonaceous solid comprises coal wherein higher rank coal has a surface area per unit weight coal at least twice the surface area per unit weight of the lower rank coal.

8. Composition of claim 1, wherein the carbonaceous solid comprised coal wherein higher rank coal has a surface area per unit weight coal at least three times the surface area per unit weight of the lower rank coal.

9. Composition of claim 1, wherein the carbonaceous solid comprises 75 to 90% low rank coal and 10 to 25% high rank coal.

* * * * *

UNITED STATES PATENT AND TRADEMARK OFFICE

CERTIFICATE OF CORRECTION

PATENT NO. : 4,783,198

DATED : November 8, 1988

INVENTOR(S) : M. Mihkel Mathiesen

It is certified that error appears in the above-identified patent and that said Letters Patent is hereby corrected as shown below:

Title Page, lefthand side, under "United States Patent [19]" the word "Hueschen" should be changed to read -- Mathiesen --

Title Page, [75] Inventor:; delete "Gordon W. Hueschen" and insert -- M. Mihkel Mathiesen --

Title Page, on the righthand side, under "Assistant Examiner — Margaret B. Medley" insert as a new line -- Attorney, Agent, or Firm — Gordon W. Hueschen --

Col. 3, line 18; "portions" should read -- portion --
Col. 3, line 20; "contituting" should read -- constituting --
Col. 3, line 24; "burhable" should read -- burnable --
Col. 3, line 48; "coak" should read -- coal --
Col. 3, line 67; "D3716-74" should read -- D3176-74 --
Col. 4, line 10; "rolatile" should read -- volatile --
Col. 4, line 39; "Tailheiyo" should read -- Taiheiyo --
Col. 4, line 68; "kilomgram" should read -- kilogram --
Col. 5, line 14; delete the period "." at the beginning of the paragraph.
Col. 5, line 55; "results" should read -- result --
Col. 5, line 65; "than" should read -- the --
Col. 7, line 57; "D5176-74" should read -- D3176-74 --
Col. 8, line 24; "advantageous" should read -- advantages --
Col. 9, line 10; "stpes" should read -- steps --
Col. 9, line 32; "area;" should read -- area, --

UNITED STATES PATENT AND TRADEMARK OFFICE

CERTIFICATE OF CORRECTION

PATENT NO. : 4,783,198

DATED : November 8, 1988

INVENTOR(S) : M. Mihkel Mathiesen

It is certified that error appears in the above-identified patent and that said Letters Patent is hereby corrected as shown below:

Col. 10, line 7; after "wherein" insert -- the --
Col. 10, line 26; "comprised" should read -- comprises --

Signed and Sealed this

Twentieth Day of June, 1989

*Attest:*

*Attesting Officer*

DONALD J. QUIGG

*Commissioner of Patents and Trademarks*